US007258092B2

(12) United States Patent
Beaucaire et al.

(10) Patent No.: US 7,258,092 B2
(45) Date of Patent: Aug. 21, 2007

(54) APPARATUS AND METHOD FOR PRE-CYCLE WARM-UP VIA WIRELESS COMMUNICATION

(75) Inventors: James Beaucaire, Glen Ellyn, IL (US); Kenneth Seymour, II, Plymouth, WI (US); William Warren, Naperville, IL (US); Radek Oleksiewicz, Riverwoods, IL (US); Susan Lukasik, Lombard, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 11/312,304

(22) Filed: Dec. 20, 2005

(65) Prior Publication Data

US 2006/0144360 A1 Jul. 6, 2006

Related U.S. Application Data

(63) Continuation-in-part of application No. 10/675,464, filed on Sep. 30, 2003, now Pat. No. 6,981,480.

(51) Int. Cl.
*F02N 17/02* (2006.01)

(52) U.S. Cl. ..... 123/142.5 E; 123/179.2

(58) Field of Classification Search ..... 123/142.5 R, 123/142.5 E, 179.2
See application file for complete search history.

(56) References Cited

U.S. PATENT DOCUMENTS

| | | | | |
|---|---|---|---|---|
| 3,455,403 | A * | 7/1969 | Hawthorne | 180/167 |
| 3,862,429 | A | 1/1975 | Bucher | |
| 4,080,537 | A | 3/1978 | Bucher | |
| 4,183,341 | A | 1/1980 | Eastman | |
| RE30,686 | E | 7/1981 | Bucher | |
| 4,318,374 | A | 3/1982 | Yasuhara | |
| 4,444,160 | A | 4/1984 | Steele | |
| 4,591,691 | A | 5/1986 | Badali | |
| 4,669,430 | A | 6/1987 | Reinold et al. | |
| 5,012,070 | A * | 4/1991 | Reed | 219/202 |
| 5,129,376 | A * | 7/1992 | Parmley | 123/179.2 |
| 5,222,661 | A * | 6/1993 | Wenhart | 236/49.3 |
| 5,285,963 | A * | 2/1994 | Wakefield et al. | 237/2 A |
| 5,727,384 | A | 3/1998 | Ma | |
| 5,791,407 | A * | 8/1998 | Hammons | 165/202 |
| 5,990,800 | A * | 11/1999 | Tamaki et al. | 340/679 |
| 6,005,761 | A | 12/1999 | Izawa et al. | |
| 6,059,197 | A | 5/2000 | Kurahashi et al. | |
| 6,147,418 | A | 11/2000 | Wilson | |
| 6,164,258 | A | 12/2000 | Petrovich et al. | |

(Continued)

FOREIGN PATENT DOCUMENTS

| | | | |
|---|---|---|---|
| GB | 2 242 260 | A * | 9/1991 |

*Primary Examiner*—Erick Solis
(74) *Attorney, Agent, or Firm*—Susan L. Lukasik; Elias P. Soupos; Jeffrey P. Calfa

(57) ABSTRACT

A signal is received (201, 301) via a wireless communication channel, which signal requests initiation of pre-cycle warm-up for one or more components of an internal combustion engine. It is determined (203, 303) whether at least one of the one or more components requires pre-cycle warm-up. When at least one of the one or more engine components requires pre-cycle warm-up, the at least one of the one or more components is warmed up (205, 207, 305, 307).

20 Claims, 2 Drawing Sheets

U.S. PATENT DOCUMENTS 6,205,010 B1 3/2001 Ohsaka et al.
2004/0178050 A1* 9/2004 Wylde ..... 200/61.88
2004/0178683 A1* 9/2004 Hermetz et al. ..... 307/141
2004/0204816 A1* 10/2004 Dery ..... 701/113
2005/0208894 A1* 9/2005 Conner et al. ..... 455/41.2

* cited by examiner

FIG. 1
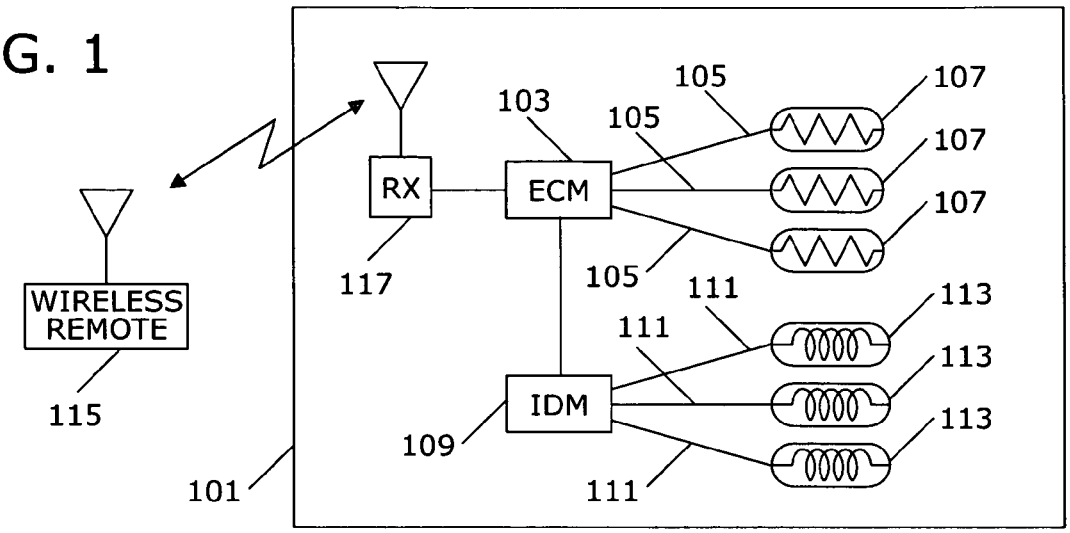
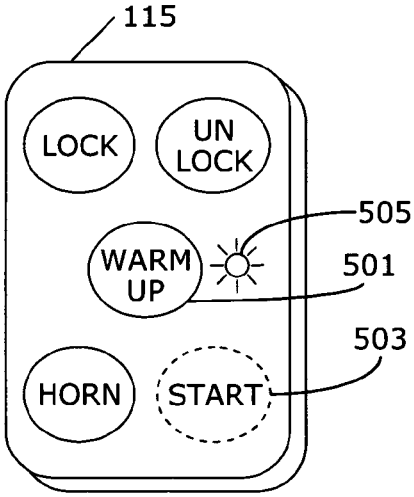
FIG. 5
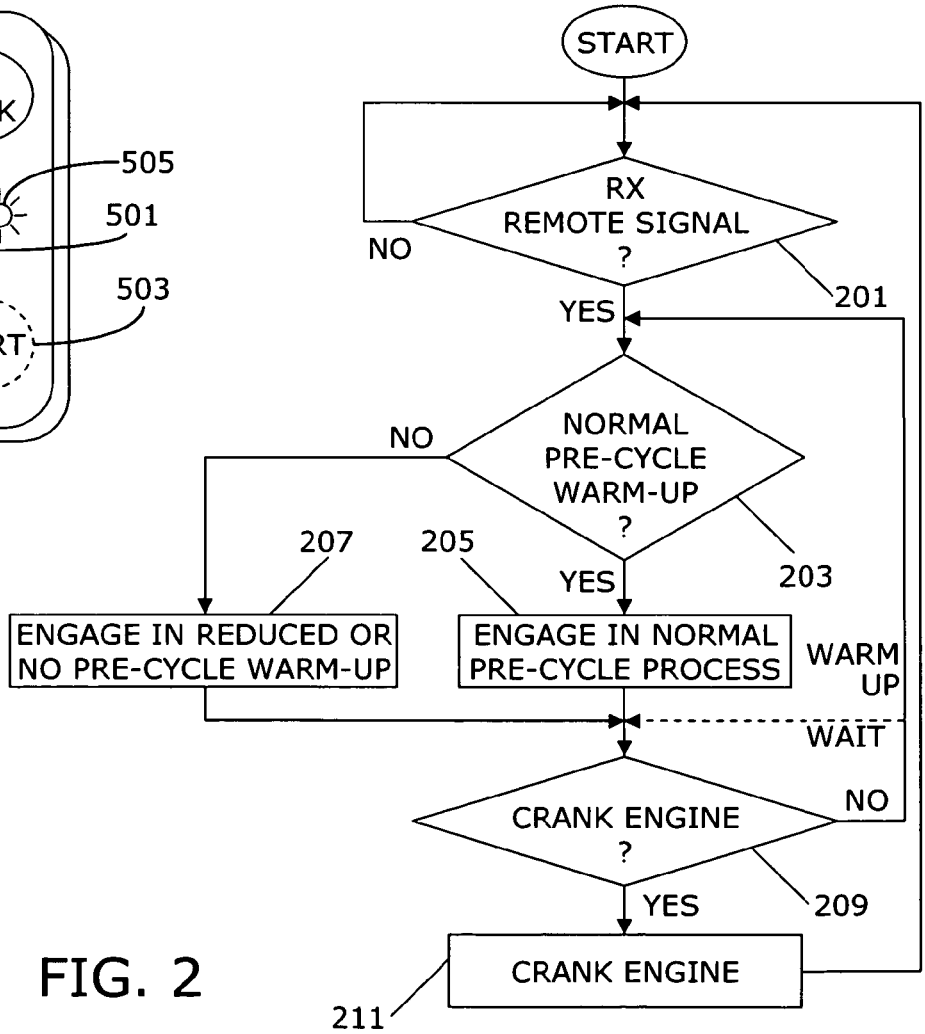
FIG. 2

APPARATUS AND METHOD FOR PRE-CYCLE WARM-UP VIA WIRELESS COMMUNICATION

CLAIM OF PRIORITY

This application is a continuation-in-part application of and claims the priority benefit of the filing date of Non-Provisional application Ser. No. 10/675,464 filed Sep. 30, 2003 now U.S. Pat. No. 6,981,480 that is assigned to the assignee hereof.

FIELD OF THE INVENTION

This invention relates to pre-cycle warm-up for electronic components of international combustion engines, including but not limited to remote control of pre-cycle warm-up for electronic components of international combustion engines.

BACKGROUND OF THE INVENTION

When internal combustion engines are cold, it is known to engage pre-cycle warm-up processes to help the engine warm up more quickly. For example, fuel injectors that are oil driven have injector coils that receive a series of short pulses to cause them to rapidly move the injector spool back and forth to loosen up the injector spool by warming it up. Similarly, a glow plug is utilized to warm up the cylinders of the engine to aid fuel ignition in a cold engine.

Pre-cycle warm-up processes are often time-consuming, and the engine cannot be started prior to the pre-cycle warm-up. Because the operator must wait for the end of the pre-cycle warm-up to start the engine, the operator will be cold while waiting to start the engine.

Accordingly, there is a need for a method of warming up an internal combustion engine with a pre-cycle warm-up process more quickly.

SUMMARY OF THE INVENTION

A method includes receiving, via a wireless communication channel, a signal requesting initiation of pre-cycle warm-up for one or more components of an internal combustion engine. It is determined whether at least one of the one or more components requires pre-cycle warm-up. When at least one of the one or more engine components requires pre-cycle warm-up, the at least one of the one or more components is warmed up.

BRIEF DESCRIPTION OF THE DRAWINGS

FIG. 1 is a block diagram illustrating a system for implementing remote pre-cycle warm-up for an electronic component in an internal combustion engine in accordance with the invention.

FIG. 2 is a flowchart illustrating a method of remote pre-cycle warm-up for an electronic component in accordance with the invention.

FIG. 5 is a diagram illustrating a remote control suitable for signaling pre-cycle warm-up in accordance with the invention.

DESCRIPTION OF A PREFERRED EMBODIMENT

Figure 3:
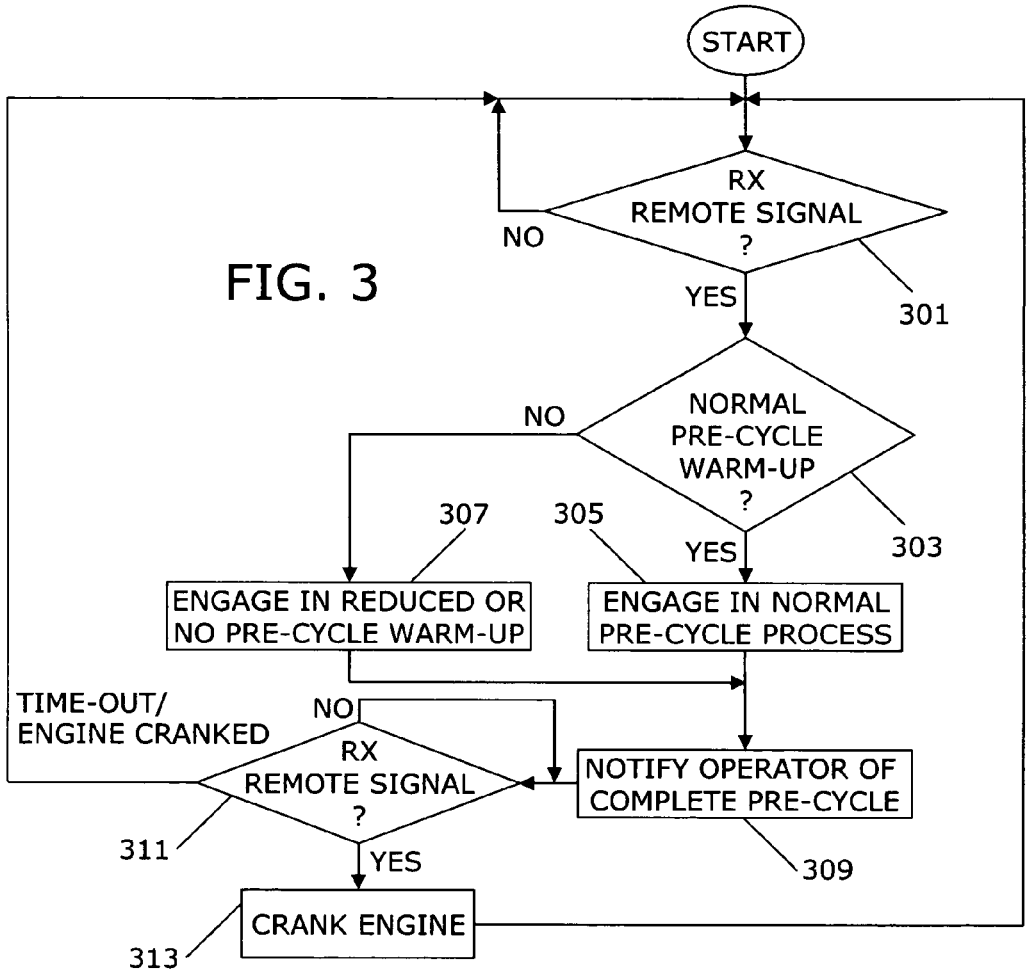
FIG. 3 is a flowchart illustrating an alternative method of remote pre-cycle warm-up for an electronic component in accordance with the invention.

The following describes an apparatus for and method of providing remote signalling to facilitate warming up components of an internal combustion engine. Once an engine controller, such as an engine control module (ECM), receives the signal from the remote, the controller determines whether pre-cycle warm-up of components, such as glow plugs or fuel injectors, is needed, and if so, to what extent. Upon pre-cycle warm-up completion, the engine may be cranked, or started, automatically, or an indication may be provided to the operator who may then crank the engine manually or send another signal requesting the engine be cranked. Optionally, a determination may be made to conserve battery power and only warm-up some of the components.

Reference is made to Non-Provisional application Ser. No. 10/675,464 filed Sep. 30, 2003, the entire contents of which are incorporated herein by reference.

A system for implementing remote pre-cycle warm-up for an electronic component in an internal combustion engine is shown in FIG. 1. The example of FIG. 1 shows an internal combustion engine 101 with a first driver controller 103 that is an engine control module (ECM) 103 that interfaces with numerous sensors for the engine, e.g., temperature sensors and pressure sensors, and determines various control signals 105 for different engine components 107, such as fuel injectors, glow plugs, air intake heaters, fuel heaters, grid heaters, electromechanical devices requiring pre-cycling, and so forth. The example shown in FIG. 1 illustrates the path of control signals 105 utilized to control the turning on and off of glow plugs 107, for example, during the pre-cycle warm-up process for the engine cylinders.

The example of FIG. 1 shows an internal combustion engine 101 with a second driver controller 109 that is an injector driver module (IDM) 109. The ECM 103 also sends signals to other control modules, such as the IDM 109, for example, to control when and what signals are sent to the fuel injectors 113. The ECM 103 may also receive signals from the IDM 109. The IDM 109 may process and/or forward the signals from the ECM 103, and/or may generate its own signals to control the fuel injectors. As shown in FIG. 1, a plurality of injector control signals 111 are utilized to energize and de-energize the fuel injector coils that are part of fuel injectors 113. These signals 111 include fuel pulse signals that determine when fuel is delivered and how much fuel is delivered. These signals 111 also include the rapid-cycling signals sent during the pre-cycle warm-up for the fuel injectors, which rapid-cycling signals, for example, may cause the fuel injector's spool to overcome stiction force and break loose of the initial resistance to movement, for example, at low temperatures.

A wireless remote 115 is shown in more detail in FIG. 5, such as a typical commercially available wireless remote as known in the art to transmit remote signals to a vehicle. Such signals include signals that open locks, open hatches, start or crank the engine, blow the horn, or provide other remote signals to a vehicle as known in the art. Such a wireless remote 115 is typically a portable hand-held device that is battery driven as known in the art. The wireless remote transmits a signal to a wireless receiver 117 that is operably coupled to the ECM 103. The wireless receiver 117 may be a typical wireless receiver as known in the art for receiving wireless communications from the wireless remote 115, also as known in the art. These wireless devices typically transmit signals over radio frequencies, although the wireless remote 115 and receiver 117 may utilize infrared frequencies or other wireless media for communication, as known in the art.

A method of remote pre-cycle warm-up for an electronic component is shown in the flowchart of FIG. 2. At step 201, when the ECM 103 receives a wireless signal through from the remote 115 through the wireless receiver 117. The wireless signal is created by the remote 115, for example, by pressing a warm up button 501 on the remote, as shown in FIG. 5, which creates a known signal and transmits it over a wireless communication channel to the receiver 117. The process continues with step 203, where it is determined whether a normal pre-cycle warm-up is needed. This determination includes comparing of temperature signals or other relevant information, such as time from last warm-up, to determine whether it is necessary to engage a full pre-cycle warm-up process, whether a reduced pre-cycle warm-up process may be utilized, or whether pre-cycle warm-up may be eliminated entirely. For example, the ECM 103 may determine if a temperature of the components 107 or 113 or a driver therefor exceeds a predetermined temperature, and, if so, engaging in either a reduced pre-cycle warm-up, if a first temperature is exceeded, or eliminating pre-cycle warm-up entirely if a second temperature is exceeded. If some components are considered sufficiently warmed-up and others are not, reduced pre-cycle warm-up may be engaged by utilizing reduced current, reduced time, or warming up less than all of the components.

This determination 203 may alternatively comprise comparing a temperature of one or more fluids of the internal combustion engine to predetermined temperature for each fluid. If a first temperature condition is exceeded, a reduced pre-cycle warm-up may be engaged. If a second temperature condition is exceeded, pre-cycle warm-up may be eliminated altogether. A combination of temperature conditions may be utilized to determine if pre-cycle warm-up may be needed and to what extent it is applied. For example, if oil, fuel, and coolant temperatures all exceed a temperature condition set for each fluid, it may be determined that no warm-up is needed no matter what the component temperature conditions are. Temperature conditions for a single fluid may be utilized, or temperature conditions for two or more fluids may be utilized. For example, if oil reaches 20 C, fuel reaches 10 C, and/or coolant reaches 20 C, it may be determined that no pre-cycle warm-up is needed. Similarly, if oil reaches 10 C, fuel reaches 0 C, and/or coolant reaches 10 C, it may be determined that reduced pre-cycle warm-up is needed. In another example, glow plug warm-up may be 2 minutes for coolant temperature below 0 C and vary linearly from 2 minutes to 0 seconds from 0 C to 70 C coolant temperature. Temperatures and warm-up times for components are empirically obtained and very based on engine size, number of cylinders, type of component, and other variables. Times may also vary based on ambient pressure. Alternatively, a combination of driver/component temperatures and one or more fluid temperatures may be utilized. Driver temperatures and related warm-up times are also empirically obtained.

The process may be optionally enhanced by approximating how much current is left in the battery 413 for the internal combustion engine 101. Data for estimating existing current and remaining current is empirically determined based on the particular battery, starter, and engine. Data is also stored anticipating current usage for each component during warm-up. Based on the approximated current, the ECM 103 may warm up some but not all of the components such that sufficient current remains in the battery to crank the internal combustion engine 101. For example, a battery sensor 411 operably coupled to the battery 409 may obtain a condition of the battery 409, such as present charge, current, or current capacity, transport that condition as a battery condition signal to the ECM 103, and based on that condition, warming up only a fraction of the components such that enough current remains in the battery to crank the engine 101. In this manner, one does not disable the vehicle's primary function by engaging a pre-cycle warm-up process.

If at step 203, it is determined that pre-cycle warm-up is needed, a normal or standard pre-cycle process is engaged at step 205, and the process continues with step 209. If at step 203, one or more conditions are exceeded, the ECM 103 suitably reduces or eliminates pre-cycle warm-up for the appropriate components 107 or 113 at step 207, and the process continues with step 209.

At step 209, it is determined whether the engine is to be cranked. For example, if the fuel temperature is too cold, the ECM 103 may disengage the start key to reduce any possible emissions that may occur from the engine or its fuel being too cold. In this case, the process continues with step 203. Alternatively, the process may continue with step 203, where the process waits until an indication is received to crank the engine or the engine is cranked manually. Optionally, at step 209, the ECM 103 may have a preprogrammed automatic command to crank the engine upon conclusion of pre-cycle warm-up. Once the engine is cranked, or started, at step 211, the process then continues with step 201.

A flowchart illustrating an alternative method of remote pre-cycle warm-up for an electronic component is shown in FIG. 3. At step 301, when the ECM 103 receives a wireless signal through from the remote 115 through the wireless receiver 117. The wireless signal is created by the remote 115, for example, by pressing a warm up button 501 on the remote, as shown in FIG. 5, which creates a known signal and transmits it over a wireless communication channel to the receiver 117. The process continues with step 303, where it is determined whether a normal pre-cycle warm-up is needed, in the same way as determined at step 203. If normal pre-cycle warm-up is to take place, the process continues at step 305 where a normal or standard pre-cycle process is engaged. If a reduced or eliminated pre-cycle warm-up is determined at step 303, the process continues with step 307, where a reduced pre-cycle warm-up is engaged or pre-cycle warm-up is eliminated.

Figure 4:
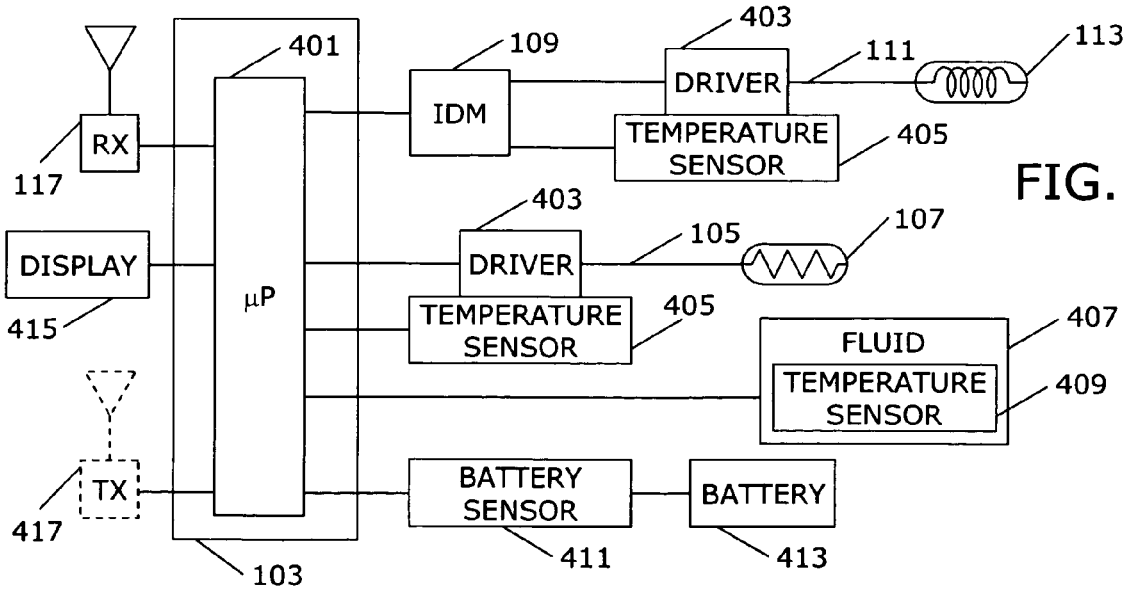
FIG. 4 is a block diagram illustrating an apparatus for implementing remote pre-cycle warm-up for an electronic component in an internal combustion engine in accordance with the invention.

After step 305 or 307, the process continues with step 309, where the operator is notified of a completed pre-cycle process. Such a notification may take place in any number of ways. For example, the ECM 103 may send a text message for display on a display 415 such as the vehicle dashboard, such as shown in FIG. 4. Optionally, the ECM 103 may honk the vehicle's horn once or twice to indicate pre-cycle completion. Alternatively, the processor may send an indication to the remote 115 via an optional wireless transmitter 417, such as shown in FIG. 4. The receiver 117 and transmitter 417 may be implemented in a single transceiver, or as separate items. The remote 115, which is modified to receive the wireless signal from the transmitter 417, transforms the wireless signal into an indication for the operator, such as turning on a solid or blinking light 505, such as a light-emitting diode, or engaging a vibrator on the remote 115. When the operator notices the indication, the operator may respond by sending a remote signal to the ECM at step 311 by pressing a button on the remote, such as the warm-up button 501 previously utilized to trigger pre-cycle warm-up or a start button 503 if the remote 115 and ECM 103 are constructed to receive a start signal such as with a remote starter. When a remote signal requesting engine crank is received at step 311, the ECM 103 proceeds to crank, or start, the engine at step 313, and the process continues with step 301. If no remote signal is received by the ECM 103 over a significant period of time, such as two minutes, or if the engine is manually cranked, the process continues with step 301.

A block diagram illustrating an apparatus for implementing remote pre-cycle warm-up for an electronic component is shown in FIG. 4. The ECM 103 utilizes a processor 401, which may be one or more microprocessors and/or other similar or related devices including memory, to run a predetermined program to provide desired functionality based on signals received at or generated by the processor 401, as known in the art. One of the functions of the processor 401 is to send signals to one or more drivers 403 that provide a signal 105 in the form of a voltage and current for a duration of time to the electronic component 107 that is to be controlled. The processor 401 also includes and runs a program based that implements the steps of the flowchart(s) of FIG. 2 and/or FIG. 3.

One or more temperature sensors 405 may be utilized in conjunction with the drivers 403. Each temperature sensor 405 may be a stand-alone thermocouple that is disposed on one or more drivers 403 or may be a built-in temperature sensor that is integral to one or more drivers 403. The temperature sensor 405 monitors the temperature of its associated driver 403, and sends the temperature as a signal to the processor 401. The processor 401 may act on the temperature signal itself or may relay the temperature signal to another module. For example, the IDM 109 may process the temperature signal and/or may relay the temperature signal to the ECM 103. One or more additional temperature sensors 409 may also be utilized. These sensors 409 may be disposed in one or more engine fluids, such as oil, coolant, and/or fuel. The sensors 409 send an appropriate temperature signal to the processor 401 for processing.

The processor 401 interprets the temperature signals in light of one or more temperature conditions. The temperature signals may also be utilized to determine if a specific component 107 or 113 is operating. For example, if the component 107 or 113 is not operating, it may cause the driver 403 to either overheat or provide no power, in which case the temperature would be lower than expected. When temperature signals from different components either overheat or provide no power, in which case the temperature would be lower than expected. When temperature signals from different components 107 or 113 of the same type are compared, a component 107 or 113 that is not functioning correctly is likely to have a substantially different temperature.

When one or more temperature conditions for a driver are exceeded, the processor 401 reduce or eliminates pre-cycle warm-up for the electronic component 107 or 113 associated with the driver 403. When the driver 403 for a component 107 or 113 has exceeded a temperature condition, such as an absolute temperature or a temperature differential, the driver 403 is presumed to be warm enough from recently driving the electronic components 107 or 113, which are in turn presumed to be warm enough from being electronically driven. Thus, reducing pre-cycle warm-up when the engine is cranked helps to prevent the components from premature burn-out due to excess warm-up, as well as preserving battery charge and more quickly cranking the engine.

The drivers 403 may be, for example, field effect transistors with a built-in temperature sensor 405 or drivers with a temperature sensor 405 disposed thereon, as are known in the art. Although the drivers 403, temperature sensors 405, and battery sensor 411 are shown external to the ECM 103 and IDM 109 in FIG. 4, the drivers 403, the temperature sensors 405, and/or the battery sensor 411 may be integrated in the same housing of the ECM 103 or IDM 109. Similarly, the receiver 117 and transmitter 417 may be integrated into the housing of the ECM 103. By utilizing temperature sensors 405 within the controller 103 or 109, rather than utilizing temperature sensors outside the controller 103 or 109, e.g., on the electronic components 107 or 111, the need for providing a return path for temperature data from the devices 107 or 111 onto the controller 103 or 109 is alleviated. When multiple devices 103 or 109 are controlled in this matter, utilizing temperature sensors 405 on-board the controller 103 or 109 alleviates the need to bring multiple lines into the controller 103 or 109.

Although one temperature sensor 405 is shown for each driver 403, fewer than one temperature sensor 405 for each driver 403 may be utilized. For example, one or more temperature sensors 405 may be utilized for each type of electronic component 107 or 113. For example, if six glow plugs 107 are utilized in the engine 101, one or two temperature sensors 405 may be placed on one or two of the six drivers 403 for the glow plugs 107, instead of placing six temperature sensors 405, one on each of the six drivers for the six glow plugs 107. When the temperature threshold for any driver 403 is exceeded, the pre-cycle warm-up for all six glow plugs 107 is reduced. Similarly, one or more temperature sensors 405 may be utilized to determine whether to reduce the pre-cycle warm-up for one or more fuel injector coils or any other electronic components for which protection is desired.

The present invention provides the advantage of remote control of warm-up of components of an internal combustion engine. For example, the time it takes for a vehicle operator to walk to his or her vehicle is utilized to warm up components, such as glow plugs, fuel injectors, grid heater, and so forth, thereby reducing time that the operator sits in a cold vehicle waiting for pre-cycle warm-up to complete. Provision is made that components are warmed up so that current remains in the battery to start the engine, thereby allowing for only a minimal number of components to engage pre-cycle warm-up.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A method comprising the steps of:

receiving, via a wireless communication channel, a signal requesting initiation of pre-cycle warm-up for one or more components of an internal combustion engine;

determining whether at least one of the one or more components requires pre-cycle warm-up;

when at least one of the one or more engine components requires pre-cycle warm-up, warming up the at least one of the one or more components.

2. The method of claim 1, wherein the step of determining comprises determining a temperature of the at least one of the one or more components and if a predetermined temperature is exceeded, engaging in one of a reduced pre-cycle warm-up and eliminating pre-cycle warm-up for the at least one of the one or more components.

3. The method of claim 1, further comprising the step of automatically cranking the internal combustion engine after completion of pre-cycle warm-up.

4. The method of claim 1, wherein the step of determining comprises comparing a temperature of one or more fluids utilized in the internal combustion engine to a predetermined temperature for the fluid.

5. The method of claim 1, further comprising the step of disengaging a start key when fuel temperature of the internal combustion engine is below a predetermined threshold.

6. The method of claim 1, wherein the one or more components include one of more of glow plugs, fuel injectors, a manifold intake air heater, and a fuel heater.

7. The method of claim 1, further comprising the step of cranking the internal combustion engine upon receipt of a second signal requesting cranking of the internal combustion engine.

8. The method of claim 1, further comprising the step of indicating completion of pre-cycle warm-up on a display readable by an operator of the internal combustion engine.

9. The method of claim 1, further comprising the steps of obtaining a condition of a battery for the internal combustion engine and, based on the condition, warming up a number of the one or more components such that sufficient current remains in the battery to crank the internal combustion engine.

10. A method comprising the steps of:

receiving a first wireless signal requesting initiation of pre-cycle warm-up for one or more components of an internal combustion engine;

determining whether at least one of the one or more components requires pre-cycle warm-up;

when at least one of the one or more components requires pre-cycle warm-up, warming up the at least one of the one or more components;

cranking the internal combustion engine upon receipt of a second signal requesting cranking of the internal combustion engine.

11. The method of claim 10, further comprising the step of sending to a remote device a third wireless signal indicating completion of pre-cycle warm-up.

12. The method of claim 10, further comprising the step of indicating completion of pre-cycle warm-up on a display readable by an operator of the internal combustion engine.

13. The method of claim 10, further comprising the steps of:

approximating how much current is in a battery for the internal combustion engine;

based on the approximated current, warming up a number of the one or more components such that sufficient current remains in the battery to crank the internal combustion engine.

14. The method of claim 13, wherein when the approximated current is below a threshold, warming up only components needed to start the internal combustion engine.

15. The method of claim 10, further comprising the step of, when the first wireless signal is received at least twice in a predetermined period of time, automatically cranking the internal combustion engine after pre-cycle warm-up is completed.

16. An apparatus comprising:

a processor disposed in an engine control module, wherein the processor is constructed to determine whether one or more components requires pre-cycle warm-up;

one or more temperature sensors operably coupled to the processor such that one or more signals from the one or more temperature sensors are sent to the processor;

a wireless receiver operably coupled to the processor and arranged and constructed to receive at least one wireless signal related to pre-cycle warm-up and transport the at least one wireless signal to the processor for processing into a pre-cycle warm-up control signal;

one or more drivers arranged and constructed to drive at least one component upon receiving the pre-cycle warm-up control signal from the processor.

17. The apparatus of claim 16, further comprising a battery sensor operably coupled to the processor and a battery, such that the battery sensor transports a battery condition signal to the processor.

18. The apparatus of claim 16, further comprising a display for displaying a pre-cycle warm-up indication to an operator.

19. The apparatus of claim 16, wherein one of the one or more temperature sensors is disposed in a fluid of an internal combustion engine.

20. The apparatus of claim 16, wherein one of the one or more temperature sensors is disposed on one of the one or more drivers.

* * * * *